US011040862B2

(12) United States Patent
Brantner

(10) Patent No.: US 11,040,862 B2
(45) Date of Patent: Jun. 22, 2021

(54) FUNNEL ASSEMBLIES FOR FEEDING BEE HIVES

(71) Applicant: Daniel C. Brantner, Plano, TX (US)

(72) Inventor: Daniel C. Brantner, Plano, TX (US)

( * ) Notice: Subject to any disclaimer, the term of this patent is extended or adjusted under 35 U.S.C. 154(b) by 0 days.

(21) Appl. No.: 16/876,019

(22) Filed: May 16, 2020

(65) Prior Publication Data

US 2021/0101792 A1 Apr. 8, 2021

Related U.S. Application Data

(60) Provisional application No. 62/912,517, filed on Oct. 8, 2019.

(51) Int. Cl.
*B67C 11/02* (2006.01)
*B65B 39/00* (2006.01)

(52) U.S. Cl.
CPC ..... *B67C 11/02* (2013.01); *B65B 39/00* (2013.01)

(58) Field of Classification Search
CPC ..... B67C 11/02; B67C 2011/022; B67C 2011/025; B67C 2011/027; B65B 39/00
USPC ..... 141/340
See application file for complete search history.

(56) References Cited

U.S. PATENT DOCUMENTS 292,629 A * 1/1884 Doty ..... A61M 5/1782 141/328
422,199 A * 2/1890 Foster ..... A61M 5/1782 141/328
474,036 A * 5/1892 Wood ..... B67C 11/02 141/340
861,007 A * 7/1907 Wilhelm ..... B60K 15/04 141/312
1,676,986 A * 7/1928 Hilford ..... B67C 11/02 141/300
1,740,384 A * 12/1929 Wright ..... B67D 3/0029 222/185.1
1,740,418 A * 12/1929 Donnelly ..... B67C 11/02 141/337
2,127,788 A * 8/1938 Schmutzler ..... B67C 11/02 141/334
2,144,923 A * 1/1939 Kester ..... B67C 11/02 141/334
2,179,400 A * 11/1939 Casner ..... B67C 11/02 141/334
2,187,974 A * 1/1940 Johnson ..... A47J 31/44 141/340
2,366,529 A * 1/1945 Hoff ..... B67C 11/00 141/106
2,509,098 A * 5/1950 Howard ..... A01J 11/06 248/94
2,620,956 A * 12/1952 Pantek ..... B67C 11/02 141/328

(Continued)

*Primary Examiner* — Timothy L Maust
(74) *Attorney, Agent, or Firm* — Thrasher Associates

(57) ABSTRACT

What is disclosed is a funnel assembly comprising a funnel body having a curved rim formed at a first portion of the funnel body, the rim being contoured to hold an external object. An upper end of the funnel body is provided with an opening. A second portion of the funnel body is formed with a lower end terminating in an aperture. A third portion of the funnel body is supported by at least one assembly that securely holds the funnel upright to allow food or food supplement to flow from the external object and into the funnel and then into a division board feeder of a beehive.

1 Claim, 8 Drawing Sheets

(56) References Cited

U.S. PATENT DOCUMENTS

| | | | | | |
|---|---|---|---|---|---|
| 2,811,181 | A * | 10/1957 | Correll | B67C 11/02 | 141/340 |
| 3,335,769 | A * | 8/1967 | Ilg | B65B 39/06 | 141/340 |
| 3,426,946 | A * | 2/1969 | Chamlee | G01F 11/10 | 222/306 |
| 4,161,265 | A * | 7/1979 | Hauser | A47K 5/10 | 222/181.2 |
| 4,248,359 | A * | 2/1981 | Brock | B65G 41/002 | 222/58 |
| 6,047,748 | A * | 4/2000 | Rooker | B65B 1/06 | 141/314 |
| 7,013,934 | B1 * | 3/2006 | Hicok | B65B 39/00 | 141/297 |
| 7,270,159 | B2 * | 9/2007 | Burns | B67C 11/02 | 116/227 |
| 7,472,727 | B1 * | 1/2009 | Sherrard | B65B 67/04 | 141/10 |
| 7,588,217 | B1 * | 9/2009 | Rooker | B65B 39/08 | 248/94 |
| 9,725,292 | B2 * | 8/2017 | Friedlich | B67C 11/02 | |

* cited by examiner

FUNNEL ASSEMBLIES FOR FEEDING BEE HIVES

CROSS-REFERENCE TO RELATED APPLICATION

This application claims the benefit of priority of U.S. Provisional Patent Application No. 62/912,517, entitled Funnel Device for Filling Bee Hive Division Board Feeders, filed on Oct. 8, 2019 to common inventor Daniel Casey Brantner.

FIELD OF THE INVENTION

The present invention relates to beekeeping.

BACKGROUND

Beekeepers—both commercial and recreational—must occasionally provide some form of liquid food supplementation to their beehives. In practice, a capped division board feeder or an open division board feeder is often used to store a liquid food supplement within a beehive box. The capped division board feeder is available in various sizes with various fluid capacities, and has holes in a top cap to allow for filling, whereas an entire top portion of the open division board feeder is open to allow for easier filling of liquid food supplements.

With all types and variations of the division board feeders, the challenge for the beekeeper is to transfer the liquid food supplement from a pail, bucket or other container which can weigh upwards of fifty pounds or more, into the proper location in a capped division board feeder or open division board feeder. Physically accomplishing a feeding can be difficult enough; to do so without spilling the liquid food supplement can be particularly difficult.

In order to assist with feedings, various funnel apparatuses have been introduced in the prior arts. U.S. Pat. No. 10,485,225B1 discloses a hive top feeder assembly with a feeder housing that can attach to a top of a beehive box/container, with a downwardly protruding entrance cone with or without locking arms/wings that can attach within an opening in the hive box/container. The feeder housing can have a hollow feeder cone and a sloped ladder to allow bees to climb up and down steps to reach and consume syrup from a syrup reservoir inside the feeder housing, followed by reversing their path to go down to the hive box/container to later make honey.

Similarly, U.S. Patent No. US20060185602 discloses a supplementary bird food storage apparatus for use with known tubular bird feeders. The storage apparatus includes a storage vessel, for storing bird food, having at least a first tapered portion and a mechanism for connecting and holding in place the first tapered portion within the main body top portion of the tubular bird feeder so as to substantially prevent egress of bird food at the connection.

Further, U.S. Pat. No. 10,085,427B2 discloses a top-fill hummingbird feeder having a liquid container with a flow opening at a lower end and a removable cap at an upper end, a feeding basin positioned below the liquid container, and a valve or sealing mechanism associated with the liquid flow opening and the feeding basin. The feeding basin includes an upwardly extending cylindrical well that receives the lower end of the liquid container, and the valve or sealing mechanism includes a float valve associated with the well. The feeding basin is filled by gravity feed of the liquid in the container through the liquid flow opening when the sealing mechanism is open. When the feeding basin reaches a full position, the liquid nectar raises the float valve which, in turn, acts to close the liquid flow opening.

The conventional funnel assemblies are useful, but still require strength to lift and pour sufficient liquid, do not reliability hold their position during the filling process, and just plain miss the mark. Accordingly, there is a need for a funnel assembly for beekeeping that allows a user to focus their attention on the delivery of the food, rather than on the mechanics of a funnel or other receptacle. The present invention provides such a system and device.

SUMMARY

In a first aspect of the invention, a funnel assembly for bee hive feeding is disclosed. The funnel assembly is comprised of a funnel body having a curved rim formed at a first portion of the funnel body, where an upper end of the funnel body is provided with an opening, and a second portion of the funnel body is supported by a rod assembly. Additionally, a curved rim provides a contoured edge for holding an external object.

In one embodiment, the lower end of the funnel body is inserted through an aperture formed in the removable ridged adaptor plate that bridges over the open division board feeder. And, in an alternative embodiment, the lower end of the funnel body is inserted into an opening in a capped division board feeder.

In both embodiments, the rod assembly includes a left support leg, a right support leg and a base support, where one end of the left support leg and one end of the right support leg extend into the funnel body through support holes. There are two plate anchors with cleats attached to the base support in such a manner to allow the plate anchors to rotate around the base support. The plate anchor's cleats secure the rod assembly in position on the top portions of foundation frames in a box assembly, and rotation around the base support allows the plates anchors to be positioned at various distances relative to the hive body thereby adjusting the angle of the funnel body relative to the box assembly. Additionally, the cleats on the plate anchors further secure the plate anchors' positions on the foundation frames.

BRIEF DESCRIPTION OF DRAWINGS

The preferred embodiment of the invention will hereinafter be described in conjunction with the appended drawings provided to illustrate and not to limit the scope of the invention, wherein like designation denote like elements and in which.

DETAILED DESCRIPTION

Figure 1:
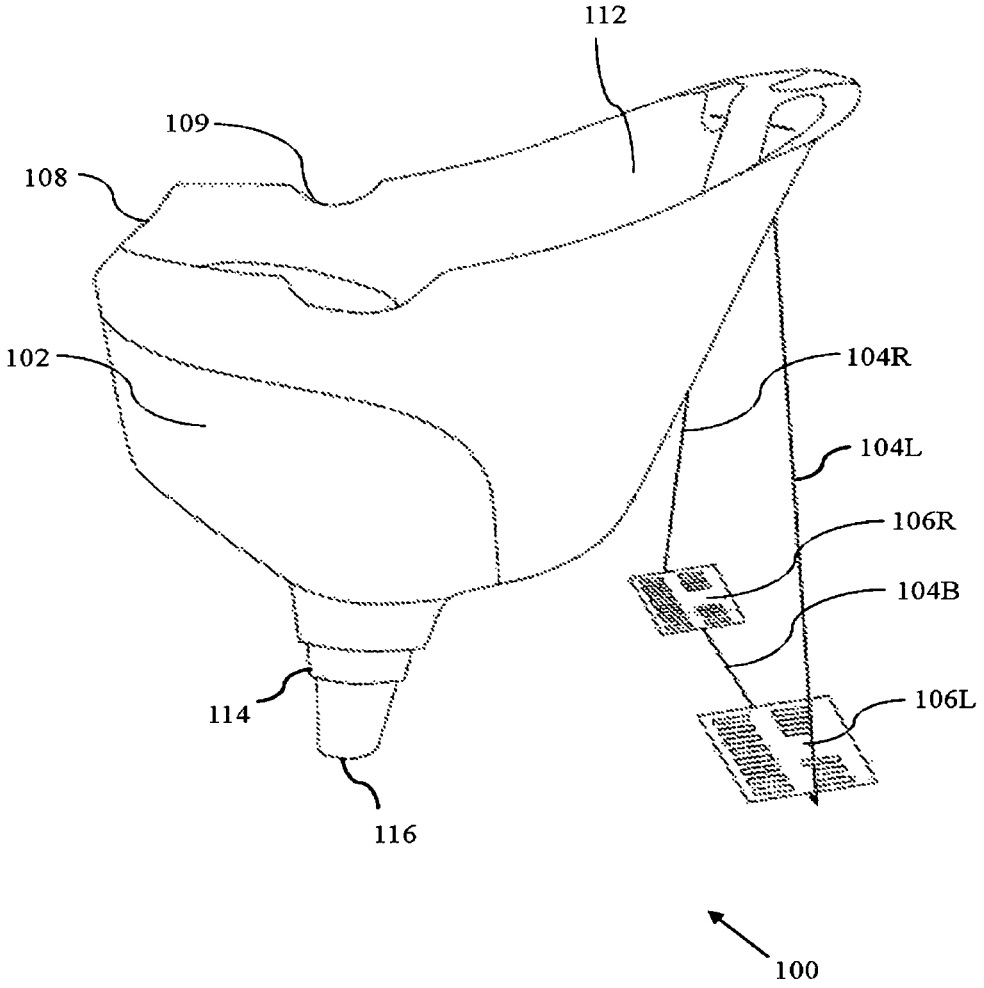
FIG. 1 is a side view of a funnel assembly.
Figure 2:
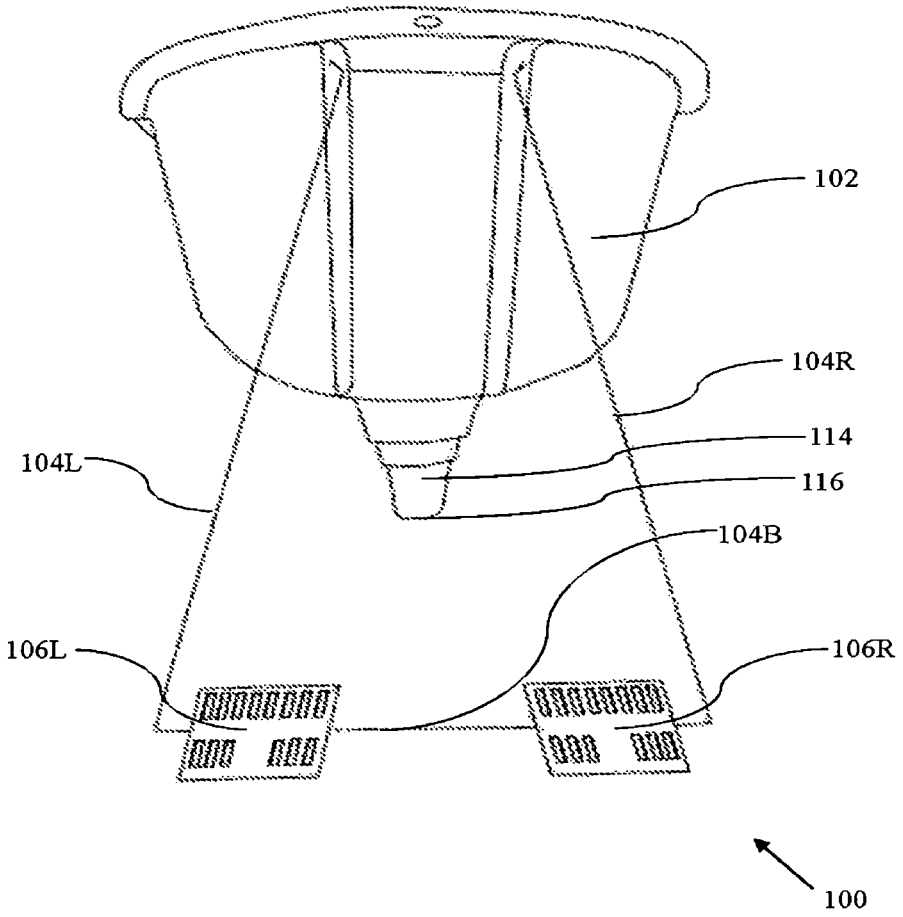
FIG. 2 is a rear view of the funnel assembly.

In the following detailed description of embodiments of the invention, numerous specific details are set forth in order to provide a thorough understanding of the embodiment of invention. However, it will be obvious to a person skilled in the art that the embodiments of invention may be practiced with or without these specific details. In other instances, well known methods, procedures and components have not been described in detail so as not to unnecessarily obscure aspects of the embodiments of the invention.

Furthermore, it will be clear that the invention is not limited to these embodiments only. Numerous modifications, changes, variations, substitutions and equivalents will be apparent to those skilled in the art, without parting from the spirit and scope of the invention.

Although the invention has been explained in relation to its preferred embodiment, it is to be understood that many other possible modifications and variations can be made without departing from the spirit and scope of the invention. Obvious changes, modifications, and substitutions may be made by those skilled in the art to achieve the same purpose the invention. The exemplary embodiments are merely examples and are not intended to limit the scope of the invention. It is intended that the present invention cover all other embodiments that are within the scope of the descriptions and their equivalents.

Conditional language used herein, such as, among others, "can," "may," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without other input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Disjunctive language such as the phrase "at least one of X, Y, Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

Unless defined otherwise, all technical and scientific terms used herein have the same meaning as commonly understood by one of the ordinary skills in the art to which this invention belongs. Although any method and material similar or equivalent to those described herein can also be used in the practice or testing of the present invention, the preferred methods and materials have been described. All publications, patents, and patent applications mentioned herein are incorporated in their entirety.

All references cited herein, including publications, patent applications, and patents, are hereby incorporated by reference to the same extent as if each reference were individually and specifically indicated to be incorporated by reference, and were set forth in its entirety herein.

The recitation of ranges of values herein is merely intended to serve as a shorthand method of referring individually to each separate value falling within the range, unless otherwise indicated herein, and each separate value is incorporated into the specification as if it were individually recited herein.

Referring in simultaneous reference to the drawings, and more particularly to FIGS. 1 through 8, are shown embodiments that emphasize selected features of the invention.

FIG. 1 is a side view of a funnel assembly 100 for adding food to a bee hive. The funnel assembly may be referred to as a bee feeder, a bee feeder funnel, a funnel assembly for feeding a bee hive, or similar language that generally describes the functional behaviour of the invention. Accordingly, a rear view of the funnel assembly 100 is depicted in the FIG. 2, and bottom view of the funnel assembly 100 with a securing plate 110 is depicted in the FIG. 3, where the plate can be a removable ridged adaptor plate. Likewise, a bottom view of the funnel assembly 100 with the removable ridged adaptor plate 110 is depicted in the FIG. 4.

As shown in the FIG. 1 to FIG. 4, the present embodiment of the funnel assembly 100 includes a funnel body 102 having a curved rim 108 to receive an external object such as a cannister, pail, bucket, or container, for example, that may be tilted to pour its contents into the funnel body 102 via a funnel opening 112. In an embodiment, a contoured rim 108 with ridges 109 provides an edge surface that accepts a cannister, pail, bucket, or container, for example. Accordingly, an upper end of the funnel body 102 comprises a funnel opening 112 for receiving food that may be a liquid, grain, or powder. A second portion of the present embodiment of the funnel body 102 comprises a lower end neck 114 that terminates at an aperture 116. The terminal portion of the end neck 114 is sized to fit into a hole in a hive division board feeder (and is typically significantly smaller than the opening 112).

A third portion of the present embodiment of the funnel body 102 comprises a rod assembly (e.g., a steel rod assembly, plastic rod assembly, or composite rod assembly, for example). The at least one rod assembly illustrated comprises a left support leg 104L, a right support leg 104R and a base support 104B. A first end 105L of the left support leg 104L and a first end 105R of the right support leg 104R are inserted into the funnel body 102 through holes 107.

Figure 3:
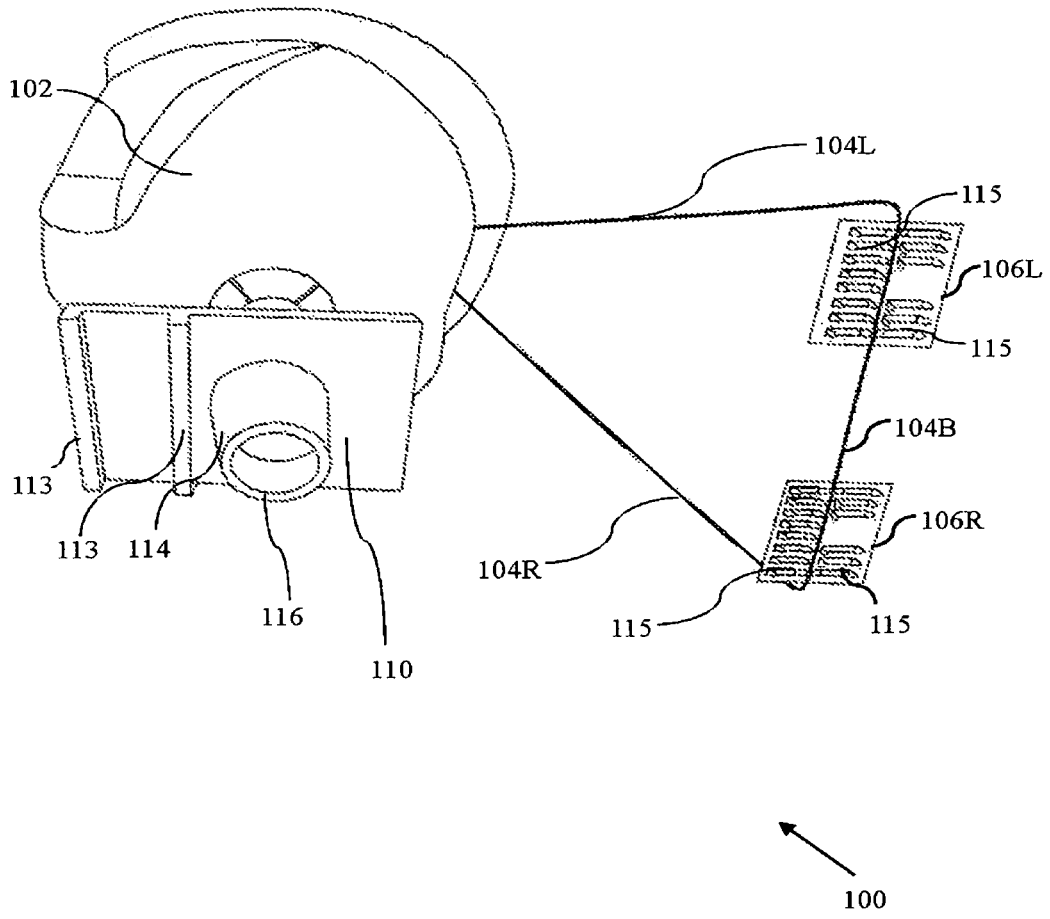
FIG. 3 is a bottom view of the funnel assembly with a removable ridged adaptor plate.
Figure 4:
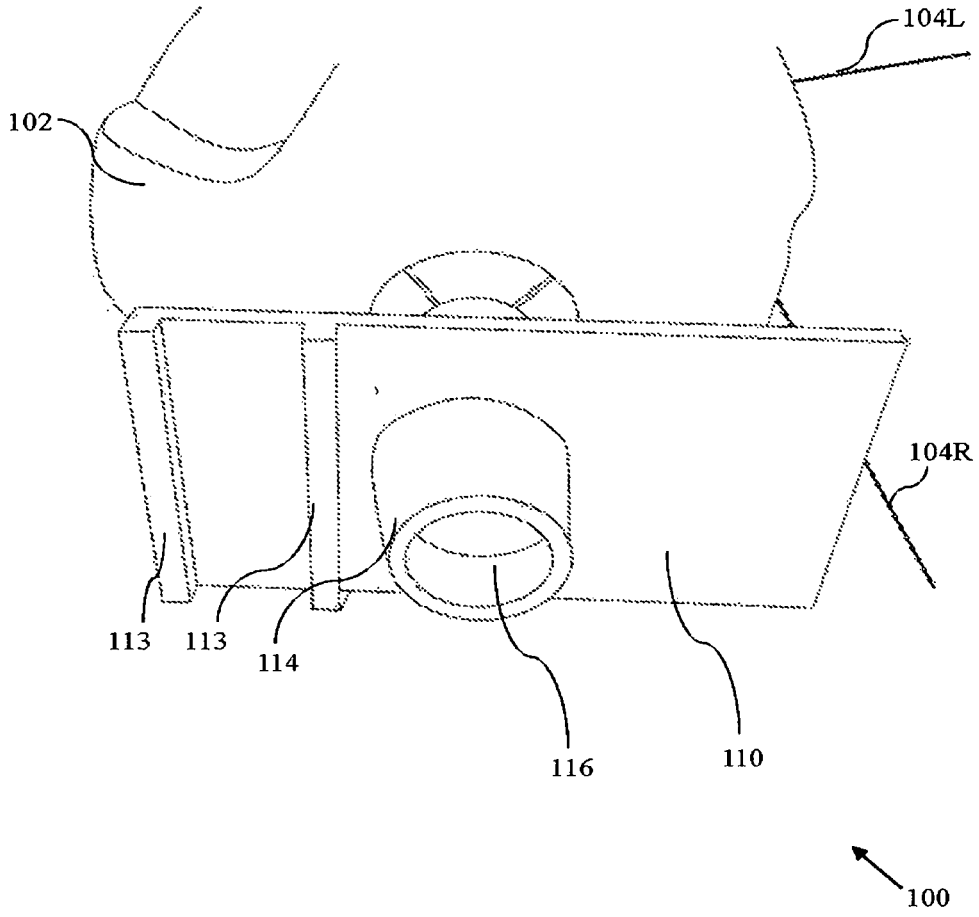
FIG. 4 is a bottom view of the funnel assembly with the removable ridged adaptor plate.

In FIG. 3, the lower end is coupled to a securing plate 110. Preferably, the securing place comprises a hole (or "aperture") 111 sized to receive the smaller portion of the neck 114 but too small to allow the larger portion of the neck 114 to protrude therethrough. Further, the securing plate 110 has support rails 113 thereon that prevent the securing plate 110 from sliding or substantially changing position on an open division board.

A base support 104B is provided with plate anchors 106L and 106R with protruding cleats 115. The plate anchors 106L and 106R are secured to the left end of the base support 104B and the right end of the base support 104B so as to allow plate anchors 106L and 106R to rotate around the base support 104B. The rotation around the base support 104B through hinges or via a contour in each plate anchor 106L, 106R allows the plate anchors 106L, 106R to be installed on top of foundation frames 202 in a box assembly 200, described below.

Figure 5:
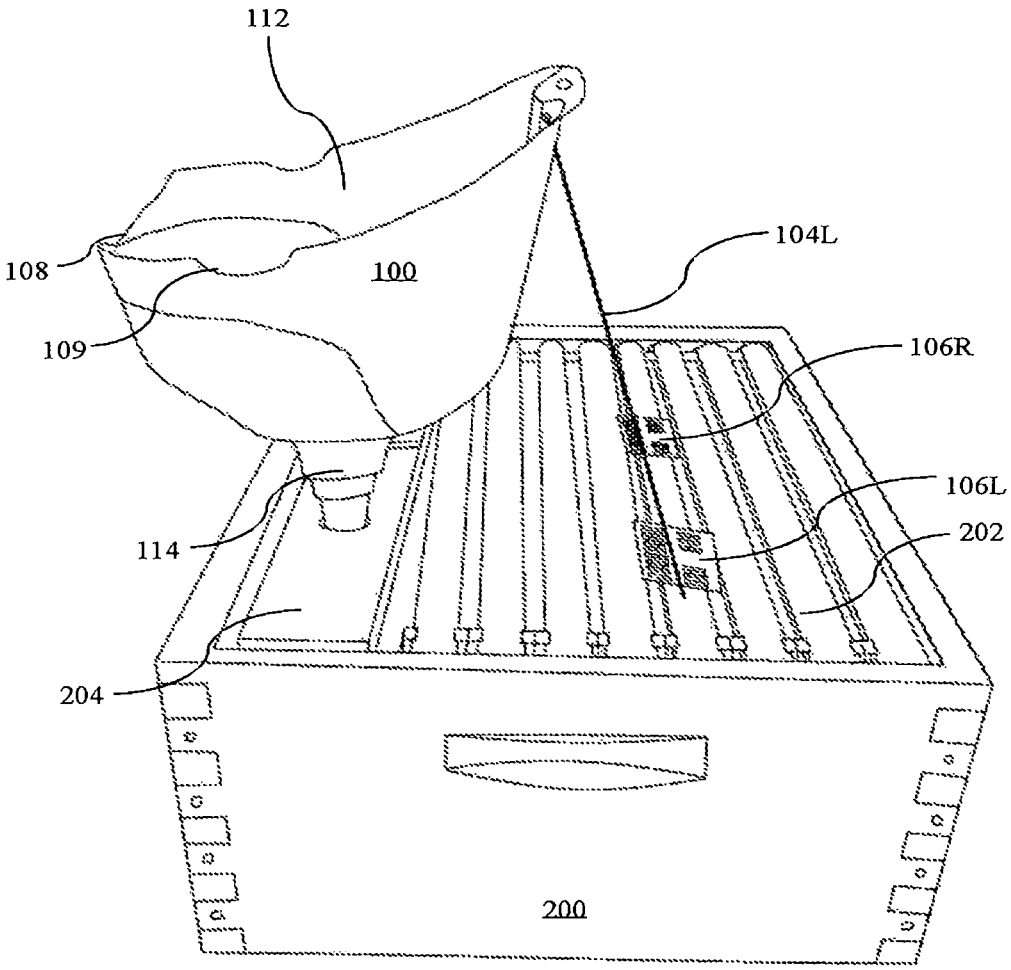
FIG. 5 is a side view of the funnel assembly without the removable ridged adaptor plate installed on a capped division board feeder.
Figure 6:
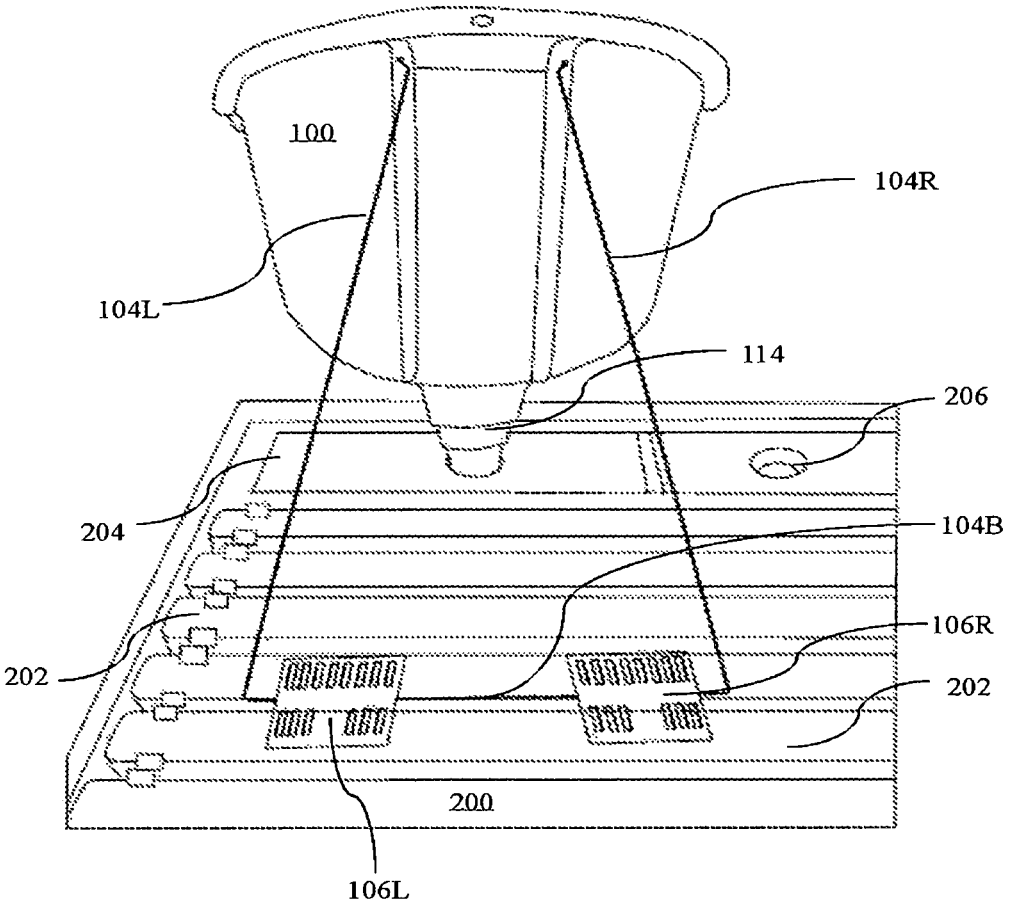
FIG. 6 is a rear view of the funnel assembly without the removable ridged adaptor plate installed on the capped division board feeder.
Figure 7:
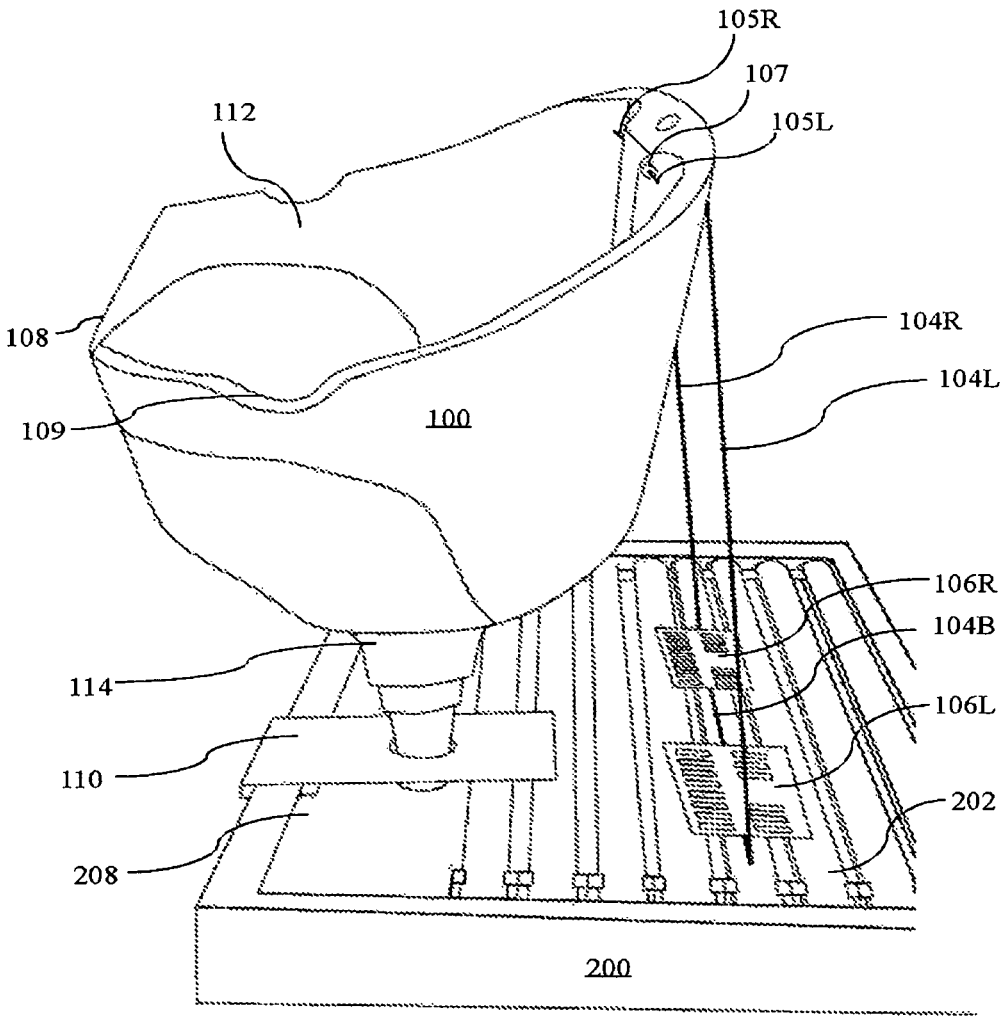
FIG. 7 is a side view of the funnel assembly with the removable ridged adaptor plate attached and installed on an open division board feeder.
Figure 8:
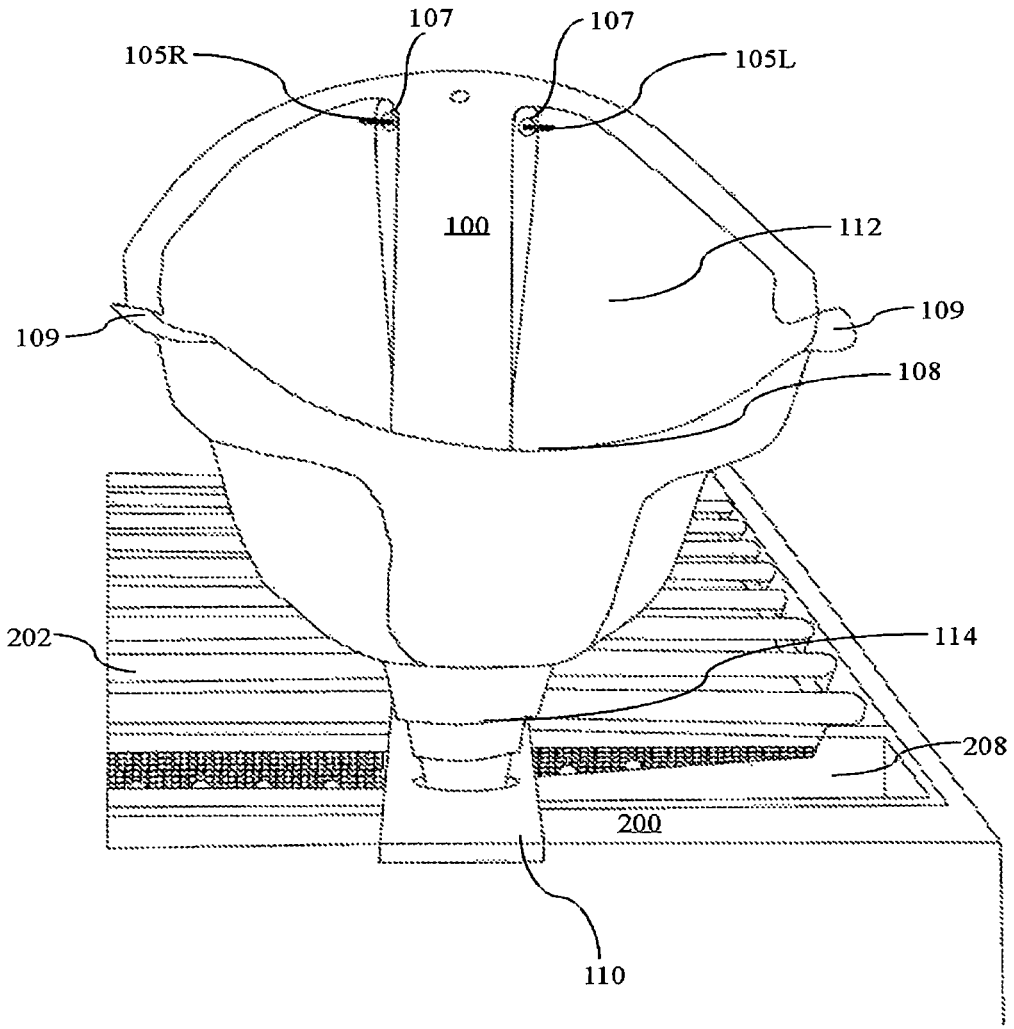
FIG. 8 is a front view of the funnel assembly with the removable ridged adaptor plate attached and installed on the open division board feeder.

A beehive box assembly is shown with simultaneous reference to FIGS. 5 through 8 (FIG. 5 to FIG. 8), in which FIG. 5 is a side view of the funnel assembly without the removable ridged adaptor plate installed on a capped division board feeder, FIG. 6 is a rear view of the funnel assembly without the removable ridged adaptor plate installed on the capped division board feeder, FIG. 7 is a side view of the funnel assembly with the removable ridged adaptor plate attached and installed on an open division board feeder, and FIG. 8 is a front view of the funnel assembly with the removable ridged adaptor plate installed on the open division board feeder.

The funnel assembly 100 is made of plastic, metal, cardboard, or other suitable material. The rim 108 at the first portion of the funnel body 102 provides a shaped edge on which to rest and stabilize the external object that contains a food or food supplement. When used to fill the capped division board feeder 204, the lower end 114 of the funnel body 102 is inserted into one of the holes in the division board feeder cap 206. The second portion (i.e., rear portion) of the funnel assembly 100 is supported and stabilized by the rod assembly.

A side view of the funnel assembly 100 (without the removable ridged adaptor plate 110) installed on a capped division board feeder 204 is depicted in FIG. 5. A rear view of the funnel assembly 100 (again, without the removable ridged adaptor plate 110) is installed on the capped division board feeder 204 is depicted in FIG. 6. A side view of the funnel assembly 100 with the removable ridged adaptor plate 110 attached and installed on an open division board feeder 208 is depicted in FIG. 7. Similarly, a front view of the funnel assembly 100 with the removable ridged adaptor plate 110 attached and installed on the open division board feeder 208 is depicted in FIG. 8.

As shown in the FIG. 5 to FIG. 8, the rotation around the base support 104B adjusts the angle of the funnel body 102 relative to the beehive box 200. The cleats on the plate anchors secure the anchor plates in position on top of the foundation frames 202 in the beehive box 200.

The plate anchors 106L and 106R and a neck of the funnel body 102 that is inserted into the hole in the division board feeder cap 206 create three points of contact which stabilize and support the funnel assembly 100. While three points of contact are optimal in the present embodiment, other embodiments may incorporate shapes and configurations that allow for four or more points of contact to support a funnel assembly.

Accordingly, the funnel assembly 100 provides a process to transfer liquid food/food supplements from a container into various types and sizes of division board feeders. The free-standing stable funnel assembly 100 allows the beekeeper to use both hands to maneuver the food supplement container thereby minimizing spillage of the liquid food supplement during transfer from the container to the division board feeder. This reduction in spillage reduces waste of the liquid food supplement and creates a cleaner, healthier environment for the bees.

The funnel assembly 100 is used to simplify the transfer of liquid syrup or other liquid nutritional supplements from the pail or the container into a beehive division board feeder. Accordingly, the funnel assembly 100 is used to fill the division board feeders 204 and 208 in a manner and "fullness" known in the art, and allows the beekeeper to transfer liquid food supplement from the external object, into a capped division board feeder 204 through a small hole on a top cap or into the open division board feeder 208 through a narrow continuous opening on top of the open division board feeder 208 without spilling, regardless of size or design of the division board feeders.

While the above detailed description has shown, described, and pointed out novel features as applied to various embodiments, it can be understood that various omissions, substitutions, and changes in the form and details of the devices or algorithms illustrated can be made without departing from the spirit of the disclosure. As can be recognized, certain embodiments described herein can be embodied within a form that does not provide all of the features and benefits set forth herein, as some features can be used or practiced separately from others.

I claim:

1. A funnel assembly, comprising:

a funnel body having a curved rim formed at a first portion of the funnel body, wherein an upper end of the funnel body is provided with an opening;

a second portion of the funnel body formed with a lower end, wherein the lower end is provided with an aperture;

a third portion of the funnel body supported by at least one rod assembly;

wherein a size of the aperture is smaller than a size of the opening;

wherein the aperture and the opening are arranged opposite to each other;

wherein the curved rim provides a contoured edge for holding an external object;

the at least one rod assembly comprises a left support leg, a right support leg and a base support;

the base support is provided with a first anchor and a second anchor;

said first and second anchors are secured onto a left end of the base support and a right end of the base support so as to allow said first and second anchors to rotate around the base support; wherein the rotation around the base support allows said first and second anchors to be installed on foundation frames in a box assembly; and said first anchor comprises at least one protruding first anchor cleat and said second anchor comprises at least one protruding second anchor cleat.

* * * * *